US005181558A

United States Patent [19]

Tsuda et al.

[11] Patent Number: 5,181,558

[45] Date of Patent: Jan. 26, 1993

[54] HEAT EXCHANGER

[75] Inventors: Yoshiyuki Tsuda, Toyonaka; Akiko Iwamoto, Osaka, both of Japan

[73] Assignee: Matsushita Refrigeration Company, Osaka, Japan

[21] Appl. No.: 779,199

[22] Filed: Oct. 23, 1991

[30] Foreign Application Priority Data

Nov. 13, 1990 [JP] Japan ..... 2-307471
Jun. 11, 1991 [JP] Japan ..... 3-138783
Jun. 11, 1991 [JP] Japan ..... 3-138784

[51] Int. Cl.[5] ..... F28F 19/02

[52] U.S. Cl. ..... 165/133; 165/151; 165/134.1

[58] Field of Search ..... 165/133, 134.1, 151; 428/329, 330, 405

[56] References Cited

U.S. PATENT DOCUMENTS 3,466,189 9/1969 Erb ..... 165/133 X
4,421,789 12/1983 Kaneko et al. ..... 427/204
4,503,907 3/1985 Tanaka et al. ..... 165/133

FOREIGN PATENT DOCUMENTS 54-39159 10/1979 Japan ..... 165/133
54-159759 12/1979 Japan ..... 165/133
58-96996 6/1983 Japan .
58-136995 8/1983 Japan .
61-243865 10/1986 Japan ..... 165/133
61-296083 12/1986 Japan ..... 165/133
2-122199 5/1990 Japan .
3-045893 2/1991 Japan .
3-139571 6/1991 Japan .

*Primary Examiner*—Allen J. Flanigan
*Attorney, Agent, or Firm*—Stevens, Davis, Miller & Mosher

[57] ABSTRACT

Disclosed are plate-shaped fins for a heat exchanger having a coated film formed thereon so that waterdrops can easily fall down from the surface of the plate-shaped fins, the coated film being composed of a solution containing a silicone coating film type resin compound and inorganic finely divided particles. Further, the inorganic finely divided particles are used to provide fine irregular portions on the surface of the coated film formed on the plate-shaped fins so that the area where the waterdrops come into contact with the surface of the fins is reduced.

5 Claims, 2 Drawing Sheets

HEAT EXCHANGER

BACKGROUND OF THE INVENTION

1. Field of the Invention

The present invention relates to a heat exchanger used for a cooling system such as an air conditioner, freezing/refrigerating apparatus and the like.

2. Description of Related Art

Recently, the ratio of heat pump type air conditioners using air as a heat source (hereinafter, referred to as a heat pump) to air conditioners has greatly increased and more than half of the room air conditioners used in homes and offices employ heat pumps. Further, most of the heat exchangers used in these heat pumps are a finned tube type heat exchanger composed of aluminum fins and coolant tubes perpendicular to the fins. In the heat pump, condensation forms on the surface of the fins of the heat exchanger disposed inside a room when air is cooled, and thus the amount of air passing through the heat exchanger is reduced by the bridge phenomenon caused by the water condensation between the fins, which results in the reduction of cooling capacity. Conversely, when air is heated, the same phenomenon as that of the above heat exchanger disposed inside the room arises in a heat exchanger disposed outside the room.

When the heat exchanger accumulates frost, the air flow resistance is increased and causes a reduction in cooling capacity. When the heat exchanger further accumulates frost, the fins become clogged due to the frost, which requires interruption of the heating operation and defrosting, and thus the comfort of heating is decreased. Consequently, to prevent the cooling and heating capacities from being reduced and the heat exchanger disposed outside the room from accumulating frost when air is heated and to reduce the number of defrosting operations to thereby improve comfort, the water condensed on the surface of the fins of heat exchangers of inside- and outside-room units must be removed at all times.

A method of removing the condensed water is to apply a water-repellent treatment to the surface of the fins to thereby cause the condensed water to fall down, and, for example, a method of coating with ethylene tetrafluoride resin, ethylene chlorotrifluoride resin and the like is known, as proposed by Japanese Utility Model Application Kokai (Laid-Open) No. Sho 51 (1976)-15261.

Since a heat exchanger to which this coating is applied has a contact angle of the surface of a fin with a water drop of about 110°, condensed water drops having a relatively large diameter of 2 mm or more can be caused to fall down from the surface of the fin.

The fin spacing of a today's heat exchanger, however, tends to be narrowed to increase the total surface area of the fins for the purpose of increasing the capacity of the heat exchanger. Today's heat exchangers generally have a fin spacing of about 2 to 3 mm and this spacing is expected to be further reduced hereinafter. When the fin spacing is reduced, a fine waterdrop having a diameter of about 1 mm will not drop from the surface of the fins by the method of coating with the above resin excellent in water repellency.

Accordingly, waterdrops remaining on the surface of the fins stay therebetween and act to retard air flow or are frozen to accumulate frost as it is, and thus the water-repellent effect of the method is not sufficient.

SUMMARY OF THE INVENTION

To solve the above problems, the present invention is characterized in that when the mixture of a solution containing a silicone resin compound and inorganic finely divided particles is coated on the surface of a plate-shaped fin, a ratio of the amount of the inorganic finely divided particles is regulated to 10 to 40 wt % of the solids content in the solution.

Further, the present invention is characterized in that the composition is strongly adhered to the plate-shaped fin.

Further, the present invention is characterized in that fine irregular portions are defined on the surface of the coated film formed on the surface of the plate-shaped fin to reduce the area where a waterdrop comes into contact with the surface.

DESCRIPTION OF PREFERRED EMBODIMENT

An embodiment of the present invention will be described below with reference to the drawings.

It should be understood that the inventors intend to cover by the appended claims all modifications following the true spirit and scope of the present invention.

Figure 1:
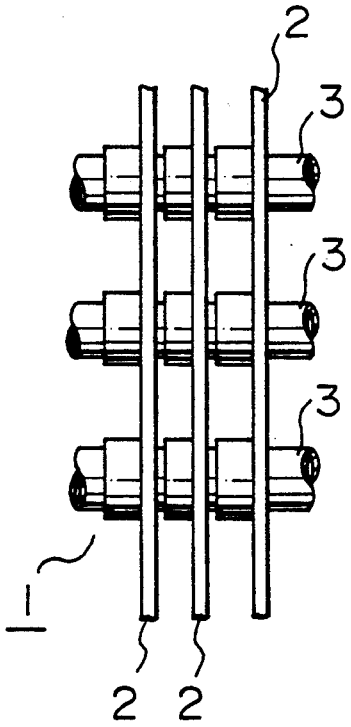
FIG. 1 is a partial cross sectional view of a fin tube type heat exchanger.

FIG. 1 shows a typical fin tube type heat exchanger wherein 1 designates the heat exchanger comprising a multiplicity of plate-shaped fins 2 each composed of an aluminium plate and disposed with a spacing left therebetween and coolant tubes 3 perpendicular to the fins 2.

Figure 2:
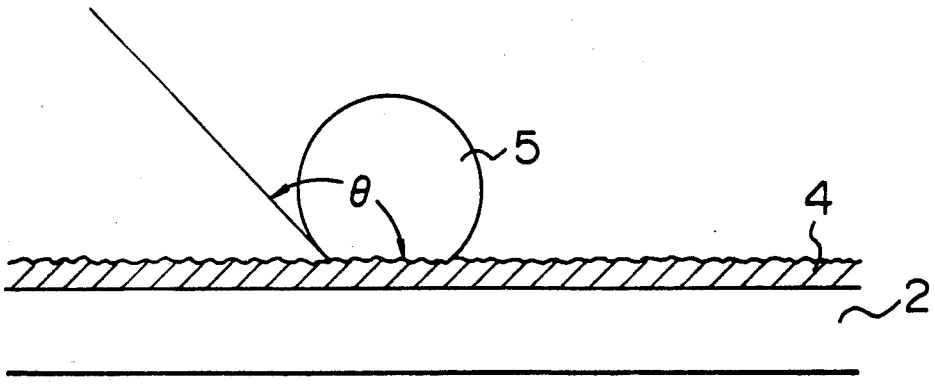
FIG. 2 is a cross sectional view showing a contact angle of a fin with a waterdrop.

Examples 1 to 3 and Comparative Examples 3 to 10 shown in Table 1 were conducted in such a manner that a coating composition was dip coated on a plate-shaped fin 2 composed of an aluminium plate having a thickness of 0.5 mm and dried and hardened for 60 minutes in a hot air drying furnace at 100° C. after the coating composition had been prepared by adding various kinds of inorganic or organic finely divided particles to a silicone resin coating agent in a predetermined amount to the solids content in the coating agent. Comparative Example 1 was conducted in such a manner that the silicone type resin coating agent was dip coated to a plate-shaped fin 2 and dried and hardened for 30 minutes in the hot air drying furnace at 100° C. in the same way. Comparative Example 2 was conducted by coating with ethylene tetrafluoride resin. The coated film was evaluated based on the surface state, intimate adhering property and water repellent effect of the coated film. The intimate adhering property was evaluated by a cross-cut adhesion test according to JIS K-5400 and the water repellency was evaluated by measuring a contact angle with water. Note, as shown in FIG. 2, the contact angle with water is represented by the angle $\theta$ between a waterdrop 5 formed on the coated film 4 on the surface of the plate-shaped fin 2 and the surface of the coated film 4, and it can be said that the greater the contact angle $\theta$, the greater the water repellency. The contact angle with water was measured by using Contact Angle Meter Model DA-T manufactured by Kyowa Kaimen Kagaku Co., Ltd.

TABLE 1

| Specimen No. | Base Resin | Additive Finely Divided Particles | Additive Amount (wt %) | Particle Diameter | Area/weight Ratio ($m^2/g$) | Water Repellency Contact Angle with Waterdrop |
|---|---|---|---|---|---|---|
| Examples | | | | | | |
| 1 | Silicone resin | Inorganic Silica | 10 | 1.8 μm | 300 | 155 |
| 2 | | | 40 | | | 160 |
| 3 | | | 10 | 400 Å | 170 | 150 |
| 4 | | | 40 | | | 160 |
| 5 | | | 10 | 170 Å | 70 | 155 |
| 6 | | | 40 | | | 160 |
| 7 | | | 10 | 4 μm | 50 | 150 |
| 8 | | | 40 | | | 155 |
| Comparative Examples | | | | | | |
| 1 | | | 5 | 1.8 μm | 300 | 135 |
| 2 | | | 5 | 400 Å | 170 | 135 |
| | | Organic Type | | | | |
| 3 | | Poly (methyl-methacry-late) Silicone | 10 | 4 μm | 50 | 100 |
| 4 | | | 40 | | | 120 |
| 5 | | | 10 | 4 μm | 1 | 100 |
| 6 | | | 40 | | | 110 |
| 7 | | | 10 | 2 μm | 15 | 110 |
| 8 | | | 40 | | | 115 |
| 9 | | — | — | — | — | 95 |
| 10 | Ethylene Tetra-Fluoride Resin | — | — | — | — | 105 |

As is apparent from Table 1, Examples 1 to 3 have a very large contact angle with water as compared with that of Comparative Examples 1 to 2 coated with only silicone type resin and ethylene tetrafluoride resin, respectively and that of Comparative Examples 5 to 10. More specifically, these Examples are shown to have a greatly improved contact angle and this is caused by the fine irregular portions formed on the surface of a coated film by adding finely divided particles to water repellent resin, in addition to the water repellent property of the water repellent resin itself. Therefore, the area of the surface with which a waterdrop comes into contact is reduced and thus the adhering force of the waterdrop on the surface is greatly reduced and the water repellency is increased thereby (this is referred to as a morphological effect). To reduce the area of the surface with which a waterdrop comes into contact, it is effective to reduce the average particle diameter of the finely divided particles and to provide the irregular portions on the surface of the finely divided particles with an acute angle, i.e., to increase the area/weight ratio of the finely divided particles. As shown in the Examples, the finely divided particle must have an average particle diameter of 4 microns or less and an area/weight ratio of 50 $m^2/g$.

Further, the difference between the effects obtained by the inorganic finely divided particles and organic finely divided particles is caused by a more acute angle is provided with the irregular portions on the surface of the inorganic finely divided particles. As shown in Comparative Examples 3 and 4, the finely divided particles must be added in an amount of 5% or more to the solids content in a solution as a base, because when the amount is less than 5%, a sufficient water repellent effect cannot be obtained. When the amount is 50% or more, however, problems arise with respect to cracks developing in a coated film, intimate adhering properties, separation of finely divided particles and the like. Note that when the surface of the inorganic finely divided particles is hydrophilic, a more uniform coated film can be formed by subjecting the finely divided particles to a hydrophobic treatment from the view point of dispersibility because the particles are liable to aggregate together and it becomes difficult to form a uniform and good film.

From the above, it is confirmed that when inorganic finely divided particles having an area/weight ratio of 50 $m^2/g$ or more and an average particle diameter of 4 microns or less are compounded into a solution so that the ratio of the particles to the solids in the solution is 10 to 40 wt %, the maximum morphological effect will be exhibited.

Consequently, when the composition is coated to the plate-shaped fins 2 of the heat exchanger 1, waterdrops adhered to the plate-shaped fin 2 fall down and thus do not remain on the surface of the plate-shaped fins 2, so that the occurrence of the clogging between the plate-shaped fins 2 caused by the frosting of the heat exchanger of a heat pump type air conditioner is reduced. As a result, the reduction of the cooling capacity and heating capacity of the heat pump is prevented and the time interval between each defrosting of the heat exchanger of an outside-room unit is prolonged, whereby comfort can be increased.

Next, other examples will be described.

As shown in Table 2, Examples 11 to 16 and Comparative Examples 11 to 19 were conducted in such a manner that a coating composition was dip coated to a plate-shaped fin 2 composed of an aluminium plate having a thickness of 0.5 mm and dried and hardened for 60 minutes in a hot air drying furnace at 100° C. after the coating composition had been prepared by adding silicon dioxide powder each having a predetermined diameter to a silicone type resin coating agent (SR2411, manufactured by Toray Silicone Co., Ltd.) in each predetermined amount to the coating agent and then stirring and dispersing the thus obtained coating agent at the normal temperature. Comparative Example 11 was conducted in such a manner that only the silicone resin coating agent was dip coated to a plate-shaped fin 2 having a thickness of 0.5 mm and then dried and hardened for 60 minutes in the hot air drying furnace at 100° C. in the same way. Note that Comparative Examples 12 to 19 used a plate-shaped fin 2 the surface of which is not subjected to a chemical film treatment and Examples 11 to 16 used a plate-shaped fin 2 which was previously subjected to a boehmite treatment, phosphoric acid alcohol treatment or chromic salt film treatment.

The water repellent effect was evaluated by measuring the contact angle with water. Note, as shown in FIG. 2, the contact angle with water is represented by the angle $\theta$ between a waterdrop 5 formed on the coated film 4 on the surface of the plate-shaped fin 2 and the surface of the coated film 4, and the greater the contact angle $\theta$, the greater the water repellency. The contact angle with water was measured by using Contact Angle Meter Model DA-T manufactured by Kyowa Kaimen Kagaku Co., Ltd. Further, the intimate adhering property of the coated film was evaluated by a pencil hardness test according to JIS-K5400.

repellent resin. When 70% or more of the silicon dioxide powder is added to the silicone resin coating agent, however, thus coated film becomes brittle and thus a good coated film cannot be obtained due to the occurrence of cracks, although the water repellency of the coating agent is improved. Further, when particles having a particle diameter exceeding 4 microns are added in an amount below 5 wt %, fine irregular portions cannot be effectively formed and thus the water repellency is lowered.

Note that although the present Examples use inorganic silica as the powder to be added, any powder that will exhibit the same effect may be used so long as fine irregular portions are formed thereby on the surface of a coated film.

On the other hand, as is apparent from Comparative Examples 11 to 16, the intimate adhering property of the coated film tends to deteriorate as the amount of the silicon dioxide powder added is increased. This is caused by the reactive radical such as silanol radical and the like which is contained in the silicone resin and contributes to the intimate adhering property of the silicone resin to the surface of the plate-shaped fin 2

TABLE 2

| | Coating Material | | | | | Water Repellency (Contact Angle with Waterdrop) | Intimate Contact Property |
|---|---|---|---|---|---|---|---|
| | | Additive Powder | | | | | |
| | Base Resin | Type | Particle Diameter | Additive Amount | Chemical Film Treatment | | |
| Examples | | | | | | | |
| 11 | Silicone Resin | Silicon Dioxide | 40 nm | 30 wt % | Boehmite Treatment | 160° | ◎ |
| 12 | | | 1.8 μm | 30 wt % | | 155° | ◎ |
| 13 | | | 40 nm | 30 wt % | Phosphoric Acid Alcohol Treatment | 160° | ◎ |
| 14 | | | 1.8 μm | 30 wt % | | 155° | ◎ |
| 15 | | | 40 nm | 30 wt % | Chromic Salt Film Treatment | 160° | ◎ |
| 16 | | | 1.8 μm | 30 wt % | | 155° | ◎ |
| Comparative Examples | | | | | | | |
| 11 | | — | — | — | — | 100° | ◎ |
| 12 | | Silicon Dioxide | 40 nm | 2 wt % | — | 120° | ◎ |
| 13 | | | 40 nm | 5 wt % | — | 145° | ○ |
| 14 | | | 40 nm | 30 wt % | — | 160° | ○ |
| 15 | | | 40 nm | 60 wt % | — | 160° | ○ |
| 16 | | | 40 nm | 70 wt % | — | 160° | X |
| 17 | | | 8 μm | 80 wt % | — | 120° | ○ |
| 18 | | | 4 μm | 80 wt % | — | 150° | ○ |
| 19 | | | 1.8 μm | 80 wt % | — | 155° | ○ |

Intimate Contact Property:
◎ . . . Pencil Hardness H or Higher
○ . . . Pencil Hardness F-HB
Δ . . . Pencil Hardness B-2B
X . . . Pencil Hardness 3B or lower or Occurrence of Cracks As is apparent from Table 2, Examples 11 to 16 and Comparative Examples 13 to 16, 18 and 19 have a very large contact angle with water as compared with that of Comparative Examples 11 and 22 coated with only the silicone resin coating agent or added with 2 wt % of the silicon dioxide powder or that of Comparative Example 17 added with the silicon dioxide having a particle diameter of 8 microns. More specifically, it is shown that the water repellency is greatly improved by the addition of 5 wt % of the silicon dioxide powder having a particle diameter of 4 microns or less. This is caused because when the fine powder is added to the water repellent resin, the area of the resin with which a waterdrop comes into contact is reduced by the fine irregular portions formed on the surface of the resin by the fine powder and thus the adhering force of the waterdrop to the surface of the resin is greatly reduced to thereby increase the water repellency, and also because the surface of the fin is made water repellent by the water which instead partially bonds to the excess inorganic silica and thus cannot bond to the surface of the plate-shaped fin, whereas when the plate-shaped fin 2 is previously subjected to the chemical film treatment such as the boehmite treatment, phosphoric acid alcohol treatment or chromic salt film treatment as in Comparative Examples 1 to 16, the intimate adhering property of the silicone type coating agent is improved to the same degree as that of the silicone type coating agent not added with the silicon dioxide powder, and that this is caused by that the chemical film treatment that makes the surface of the plate-shaped fin more active so that the reduction of bonding to the surface of the plate-shaped fin is compensated.

Consequently, the surface of the plate-shaped fin exhibits very excellent water repellency, and thus the fin has an effective capability to cause waterdrops condensed thereon to fall down therefrom even if the fin has a narrow spacing of about 2 mm. As a result, the occurrence of the clogging between the plate-shaped fins caused by the frosting of the heat exchanger of a heat pump type air conditioner is delayed and thus the reduction of the cooling capacity and heating capacity of the heat pump is prevented and intervals at which the heat exchanger of an outside-room unit is defrosted is prolonged, whereby comfortableness can be increased.

Further examples will be described.

Examples 21 to 26 shown in Table 3 were conducted in such a manner that a coating composition was dip coated to a plate-shaped fin 2 composed of an aluminium plate having a thickness of 0.5 mm and dried and hardened for 60 minutes in a hot air drying furnace at 100° C. after the coating composition had been prepared by adding inorganic finely divided particles having a predetermined particle size to a silicone type resin coating agent in an amount of 30 wt % to the solids content in the coating agent and also adding 10 wt % of various kinds of resin modifiers as an effective component and then stirring and dispersing the thus obtained coating agent at the normal temperature. Further, Comparative Examples 22 to 29 were conducted in such a manner that a coating composition was dip coated to a plate-shaped fin 2 composed of an aluminium plate having a thickness of 0.5 mm and dried and hardened for 60 minutes in the hot air drying furnace at 100° C. in the same way as Examples 23 to 25 after the coating composition had been prepared by adding inorganic finely divided particles having a predetermined diameter to a silicone type resin coating agent in a predetermined amount to the solids content in the coating agent and then stirring and dispersing the thus obtained coating agent at the normal temperature. Comparative Example 21 was conducted by dip coating only the silicone resin coating agent to an aluminium plate having a thickness of 0.5 mm and then drying and hardening the agent for 30 minutes in the hot air drying furnace at 100° C. in the same way.

The coated film was evaluated based on the intimate adhering property and water repellent effect thereof. The intimate adhering property was evaluated by a pencil hardness test according to JIS-K5400 and the water repellency was evaluated by measuring a contact angle with water. Note, as shown in FIG. 2, the contact angle with water is represented by the angle $\theta$ between a waterdrop 5 formed on the coated film 4 on the surface of the plate-shaped fin 2 and the surface of the coated film 4, and it can be said that the greater the contact angle $\theta$, the greater the water repellency. The contact angle with water was measured by using Contact Angle Meter Model DA-T manufactured by Kyowa Kaimen Kagaku Co., Ltd.

TABLE 3

| | Coating Material | | | | | Water Repellency (Contact Angle with Waterdrop) | Intimate Contact Property |
|---|---|---|---|---|---|---|---|
| | | Additive Powder | | | | | |
| | Base Resin | Type | Particle Diameter | Additive Amount | Resin Modifier | | |
| Examples | | | | | | | |
| 1 | Silicone Resin | Silicon Dioxide | 40 nm | 30 wt % | γ-aminopropyl-trimethoxysilane | 160° | ◎ |
| 2 | | | 1.8 μm | 30 wt % | | 155° | ◎ |
| 3 | | | 40 nm | 30 wt % | γ-(2-aminoethyl)-aminopropylmethyl-dimethoxysilane | 160° | ◎ |
| 4 | | | 1.8 μm | 30 wt % | | 155° | ◎ |
| 5 | | | 40 nm | 30 wt % | γ-glycidoxy-propyltrimethoxy-silane | 160° | ◎~○ |
| 6 | | | 1.8 μm | 30 wt % | | 155° | ◎~○ |
| Comparative Examples | | | | | | | |
| 1 | | — | — | — | — | 100° | ◎ |
| 2 | | Silicon Dioxide | 40 nm | 2 wt % | — | 120° | ◎ |
| 3 | | | 40 nm | 5 wt % | — | 145° | ○ |
| 4 | | | 40 nm | 30 wt % | — | 160° | ○ |
| 5 | | | 40 nm | 60 wt % | — | 160° | ○ |
| 6 | | | 40 nm | 70 wt % | — | 160° | X |
| 7 | | | 8 μm | 80 wt % | — | 120° | ○ |
| 8 | | | 4 μm | 80 wt % | — | 150° | ○ |
| 9 | | | 1.8 μm | 80 wt % | — | 155° | ○ |

Intimate Contact Property:
◎ . . . Pencil Hardness H or Higher
○ . . . Pencil Hardness F-HB
Δ . . . Pencil Hardness B-2B
X . . . Pencil Hardness 3B or lower or Occurrence of Cracks As is apparent from Table 3, Examples 21 to 26 and Comparative Examples 23 exhibit a very large contact angle with water as compared with that of Comparative Examples 21 and 22 coated with only silicone resin or added with 2 wt % of silicon dioxide powder or that of Comparative Example 27 added with silicon dioxide powder having a particle diameter of 8 microns. More specifically, it is shown that the water repellency is greatly improved by the addition of 5 wt % of the silicon dioxide powder having a particle diameter of 4 microns or less. This is caused such that when the fine particles are added to the water repellent resin, fine irregular portions are formed on the surface of the water repellent resin in addition to that water repellency is provided on the surface of the resin by the property of the water repellent resin itself. Therefore, the area of the resin with which a waterdrop comes into contact is reduced and thus the adhering force of the waterdrop on the surface of the resin is greatly reduced to thereby increase the water repellency (morphological effect).

When 70% or more of the silicon dioxide powder is added to the silicone coating agent, however the coated film becomes brittle and thus a good coated film cannot be obtained due to the occurrence of cracks, although the water repellency of the coating agent is improved. Further, when the particles having a diameter exceeding 4 microns are added in an amount below 5 wt %, fine irregular portions cannot be formed and thus the effect to improve the water repellency is lowered.

Note that although the present Examples use inorganic silica as the powder to be added, any powder which will exhibit the same effect can be used so long as fine irregular portions are formed thereby on the surface of a coated film.

On the other hand, as shown in Comparative Examples 21 to 26, the intimate adhering property of the coated film tends to deteriorate as the amount of silicon dioxide powder to be added is increased. This is caused by a reactive radical such as silanol radical and the like which is contained in silicone resin and contributes to the intimate adhering property of the silicone resin to the surface of a substrate which is partially consumed to be bonded to the added inorganic silica and loses a bonding chance of the substrate to the water repellent coating composition. On the other hand, as shown in Examples 21 to 26, when a resin modifier which has at least two kinds of reactive radical, i.e., reactive radical chemically bonding to an inorganic material such as methoxy radical, ethoxy radical, silanol radical and the like and reactive radical chemically bonding to an organic material such as vinyl radical, amino radical and the like, is added to the molecules of silicone resin, the intimate adhering property of the silicone resin is improved to the same degree as that of the silicone resin not added with the silicon dioxide powder. In particular, a resin modifier having an amine functional group in the molecules of Examples 1 to 4 has a great effect.

This is caused since the resin modifier, which has the methoxy radical and the like as the functional group chemically bonding to the inorganic material and the amino radical and the like as the functional group chemically bonding to the organic material, is added to the molecules of Examples 21 to 26, the silicone resin is strongly coupled with the inorganic finely divided particles, so that the strength of the coated film itself is increased and the chance for the substrate to be coupled with the water repellent coating composition is increased.

As described above, a water repellent coating composition which is excellent in water repellency and can be strongly coupled with a plate-shaped fin can be provided by adding the inorganic finely divided particles and resin modifier to the silicone resin. Since a heat exchanger excellent in water repellency for a long time can be provided by applying this composition to plate-shaped fins, the fins have an effective capability to cause waterdrops condensed thereon to fall down therefrom even if the fins have a narrow spacing of about 2 mm. As a result, the occurrence of the clogging between the plate-shaped fins caused by the frosting of the heat exchanger of a heat pump type air conditioner is reduced and thus the reduction of the cooling capacity and heating capacity of the heat pump is prevented and the interval between defrostings of the heat exchanger of an outside-room unit is prolonged, whereby comfort can be increased.

As shown in Table 4 as further examples, Examples 31 to 34 and Comparative Examples 31 to 33 were conducted in such a manner that a coating composition was dip coated to a plate-shaped fin 2 composed of an aluminium plate having a thickness of 0.5 mm and dried and hardened for 60 minutes in a hot air drying furnace at 100° C. after the coating composition had been prepared by adding various kinds of inorganic finely divided particles to a silicone resin coating agent which exhibited a contact angle with water of 90° or more after it had been coated and dried in a predetermined amount to the solid contents of the coating agent so that the coating agent formed predetermined irregular portions after it had been coated, dried and hardened and then stirring and dispersing the thus obtained coating agent at the normal temperature. Further, Comparative Example 34 was conducted in such a manner that an acrylic resin type coating agent having a contact angle with water below 90° similar to the above was dip coated to a plate-shaped fin 2 having a thickness of 0.5 mm and dried and hardened for 30 minutes in the hot air drying furnace at 100° C. in the same way. The coated film was evaluated based on a water repellent effect and durability of the water repellent effect. The water repellency was evaluated by measuring an contact angle with water. Note, as shown in FIG. 2, the contact angle with water is represented by the angle $\theta$ between a waterdrop 5 formed on the coated film 4 on the surface of the plate-shaped fin 2 and the surface of the coated film 4, and it can be said that the greater the contact angle $\theta$, the greater the water repellency. The contact angle with water was measured by using Contact Angle Meter Model DA-T manufactured by Kyowa Kaimen Kagaku Co., Ltd. In addition, the durability of the water repellent effect was evaluated based on the degree of deterioration of the contact angle with water of the surface of a coated film after a condensation-dry cycle had been repeated 30 times. Table 4 shows the effect of these evaluations.

TABLE 4

| | Base Resin Compound | Irregular Shape H (μ) | Irregular Shape D/0.5 H | Contact Angle with Waterdrop | Water Repellency Durability |
|---|---|---|---|---|---|
| Examples | | | | | |
| 1 | Silicone | 0.2 | 0.5 | 155° | ○ |
| 2 | Contact Angle | | 0.8 | 160° | ○ |
| 3 | with | 0.5 | 0.5 | 155° | ○ |
| 4 | Waterdrop 95° | | 0.8 | 160° | ○ |
| Comparative Examples | | | | | |
| 1 | | 0.1 | 0.3 | 130° | — |
| 2 | | | 0.5 | 150° | X |
| 3 | | | 0.8 | 160° | X |
| 4 | Acrylic Type 70° | 0.5 | 0.8 | 55° | — |

H: Spacing between projected peaks
D: Depth of irregular portions

As is apparent from the Table, the contact angle with water of Examples 31 to 34 is greatly improved as compared with that of Comparative Example 31 the irregular portions of which are D/0.5 H<0.5 and that of Comparative Example 34 coated with an acrylic paint having a contact angle with water below 90° and added with finely divided particles. More specifically, it is exhibited that the water repellency of the Examples is greatly improved. This is caused when the fine particles are added to the water repellent resin, fine irregular portions are formed on the surface of the water repellent resin in addition to that the water repellency is provided on the surface of the resin by the property of the water repellent resin itself. Therefore, the area of the resin with which a waterdrop comes into contact is reduced and thus the adhering force of the waterdrop to the surface of the resin is greatly reduced to thereby increase the water repellency.

Figure 3:
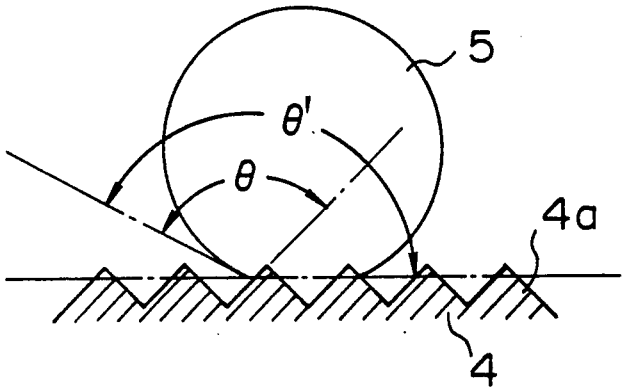
FIG. 3 is a schematic diagram of a waterdrop on a surface having a contact angle with a waterdrop of 90° or more and irregular portions defined thereon.
Figure 4:
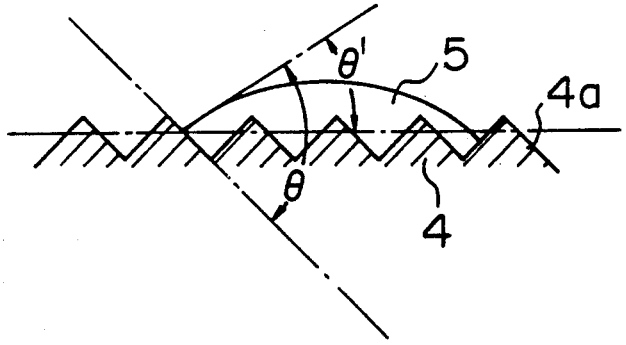
FIG. 4 is a schematic diagram of a waterdrop on a surface having a contact angle with a waterdrop below 90° and irregular portions defined thereon.

This phenomenon will be further described with reference to a schematic diagram of a waterdrop on a surface having fine irregular portions. FIG. 3 is a schematic diagram of a waterdrop on a surface having a contact angle with a waterdrop of 90° or more and irregular portions defined thereon, and FIG. 4 is a schematic diagram of a waterdrop on a surface having a contact angle with a water-drop below 90° and irregular portions defined thereon, wherein 4*a* designates the surface of the coated film 4 and 5 designates the waterdrop. Note that the contact angle with a waterdrop of the surface of a specimen itself is represented by $\theta$ and referred to as a real contact angle. Further, the contact angle of a horizontal surface with a waterdrop is represented by $\theta'$ and referred to as an apparent contact angle. As apparent from FIGS. 3 and 4, when irregular portions are formed on a surface having a contact angle with a waterdrop of 90° or more, the apparent contact angle with the waterdrop $\theta'$ on the surface is greatly increased than the real contact angle $\theta$ thereof. More specifically, the area where the waterdrop comes into contact with the surface is greatly reduced and thus water repellency is improved. Conversely, when irregular portions are formed on a surface having a contact angle with a waterdrop below 90°, the apparent contact angle with the waterdrop $\theta'$ on the surface is greatly reduced than the real contact angle $\theta$. More specifically, the area where the waterdrop comes into contact with the waterdrop is greatly increased and thus a hydrophilic nature is improved.

Further, it is found that Examples 31 to 34 are excellent in the durability of a water repellent effect as compared with that of Comparative Examples 31 to 33 in which the spacings between irregular portions are less than 0.2 microns. This is caused when water condenses on the surface of a coated film, the water enters the recesses in the fine irregular portions on the surface. Consequently, when the spacings between the irregular portions are small, the waterdrops held in the irregular portions cannot evaporate by the usual drying process and thus the water repellency of the irregular portions is deteriorated.

Therefore, when a water repellent coating agent composed of a solution containing a resin compound, the surface of the coated film of which has a contact angle with water of 90° or more after the coating agent has been coated, dried, and hardened, and inorganic or organic finely divided particles dispersed in the above solution and capable of forming fine irregular portions having the spacings L between projections thereof of 0.2 microns or more and the relationship of the spacings L and a depth D of D/0.5 L $\geqq$0.5 on the surface of the coated film after the coated film has been hardened is coated to a surface, the surface exhibits a very high water repellency as compared with that of a conventional water repellent coating agent and is excellent in the durability of its water repellent effect. As a result, even if fins have a narrow spacing of about 2 mm, the fins maintain for a long time an effective capability to cause waterdrops condensed on the surface thereof to fall down. Consequently, the occurrence of clogging between the fins caused by the frosting of the heat exchanger of a heat pump type air conditioner can be delayed, so that a reduction of the cooling capacity and heating capacity of the heat pump is prevented and the interval between defrostings of the heat exchanger of an outside-room unit is defrosted is prolonged, whereby comfort can be increased.

What is claimed is:

1. A heat exchanger, comprising:

a plurality of plate-shaped fins disposed in parallel with a predetermined spacing which allows flow therebetween; and heat transfer tubes extending across plate-shaped fins at right angles, wherein a composition comprising a solution containing a silicone resin compound and inorganic finely divided particles having a ratio of 10 to 40 wt % to the solids content in said solution, a large area/-weight ratio and a small average particle diameter is coated to said plate-shaped fins.

2. A heat exchanger according to claim 1, wherein said inorganic finely divided particles have an area/-weight ratio of 50 $m^2/g$ or more and an average particle diameter of 4 microns or less.

3. A heat exchanger according to claim 2, wherein the surface of said inorganic finely divided particles is subjected to a hydrophobic treatment.

4. A heat exchanger according to claim 1, wherein the surface of said plate-shaped fins is subjected to a chemical film treatment.

5. A heat exchanger according to claim 1, wherein said composition is filled with a resin modifier having two kinds of functional groups.

* * * * *